United States Patent [19]

Adams et al.

[11] 4,188,464

[45] Feb. 12, 1980

[54] BIPOLAR ELECTRODE WITH INTERMEDIATE GRAPHITE LAYER AND POLYMERIC LAYERS

[75] Inventors: Robert G. Adams, Niagara Falls; Dirk Pouli; Dana H. Ridgley, both of Williamsville; Donald E. Stephens, Grand Island, all of N.Y.

[73] Assignee: Hooker Chemicals & Plastics Corp., Niagara Falls, N.Y.

[21] Appl. No.: 929,589

[22] Filed: Jul. 31, 1978

[51] Int. Cl.[2] ..... H01M 6/48

[52] U.S. Cl. ..... 429/210; 429/82; 429/221; 204/290 F

[58] Field of Search ..... 429/210, 82, 221; 204/290 F, 290 R, 254–256, 268, 292–294

[56] References Cited

U.S. PATENT DOCUMENTS

| | | | |
|---|---|---|---|
| 3,565,694 | 2/1971 | Chireau | 429/210 |
| 3,884,792 | 5/1975 | McGilvery | 204/268 X |
| 3,898,102 | 8/1975 | Louis | 429/210 |
| 4,053,385 | 10/1977 | Hirozawa | 204/254 |
| 4,118,294 | 10/1978 | Pellegri | 204/290 F |
| 4,119,519 | 10/1978 | Clapper | 204/290 F |

FOREIGN PATENT DOCUMENTS

| | | |
|---|---|---|
| 45-25083 | 8/1970 | Japan. |
| 47-25982 | 7/1972 | Japan. |
| 181819 | 10/1966 | U.S.S.R.. |

*Primary Examiner*—Charles F. LeFevour

*Attorney, Agent, or Firm*—Peter F. Casella; William G. Gosz

[57] ABSTRACT

A composite bipolar electrode structure is described. The structure includes an anode face comprised of a layer of a platinum group metal, metal oxide, or mixtures thereof, deposited on a layer of a valve metal, preferably titanium, a cathode face comprised of a cathode material, suitably a ferrous material, and an intermediate layer of conductive, porous material, such as graphite, positioned to be in electrical contact between the valve metal layer and the cathode material layer. The electrode is assembled by applying a thin layer of a polymeric material on the interfaces of the porous intermediate layers and pressing the components with sufficient pressure to force the polymeric material into the interstices of the intermediate layers.

11 Claims, 2 Drawing Figures

BIPOLAR ELECTRODE WITH INTERMEDIATE GRAPHITE LAYER AND POLYMERIC LAYERS

BACKGROUND OF THE INVENTION

The present invention relates to bipolar electrodes and to their use in bipolar electrolytic cells. More particularly, the present invention relates to bipolar electrodes and their use in bipolar electrolytic cells suited for use in processes which involve the electrolysis of alkali metal halides to produce alkali metal halates, especially chlorates, such as sodium chlorate, alkali metal perhalates, halites and hypohalites.

Processes of this latter type utilize an electrolysis zone where most of the electrolytic reactions take place and, if needed, a reaction zone where certain chemical reactions, which are not electrolytic in nature, take place. Electrolyte is transferred from the electrolysis zone to the reaction zone, and, in some instances, electrolyte is recycled from the reaction zone back to the electrolysis zone. In some processes, only the electrolysis zone is needed to produce the desired product.

In the production of a chlorate, for example, the principal reactions taking place in the electrolysis zone are:

Anodic $$2\,Cl^- \rightarrow Cl_2 + 2e$$

$$Cl_2 + H_2O \rightleftharpoons HOCl + HCl$$

Cathodic $$2\,H^+ + 2e \rightarrow H_2$$

The principal reaction taking place in the reaction zone is:

$$2\,HOCl + OCl^- \rightarrow ClO_3^- + 2\,HCl$$

The term "bipolar electrolytic cell" as used herein means an electrolytic cell in which at least one of the electrodes is bipolar, that is, one face or side functions as an anode, and the other face or side functions as a cathode. In a bipolar electrolytic cell, each bipolar electrode is connected in series with the two electrodes that bracket or are adjacent to it. The two end or terminal electrodes are connected in series to a source of electricity. This is in contrast to a monopolar electrolytic cell in which all of the anodes and all of the cathodes are connected in parallel to a source of electricity.

The advantages of the use of the bipolar cells and bipolar electrodes include:

(a) bipolar cells are relatively simpler and more economical to produce than are monopolar cells;

(b) the electrical contact for supplying current to the electrodes in bipolar cells is applied only through the first and last plates while the current supply to the anodes of monopolar cells must be supplied by electrical contact established with each individual electrode.

(c) bipolar cells allow for the use of minimal intercell and interelectrode distances which facilitates a reduction in voltage and in the volume of electrolyte required.

Typically, a bipolar electrolytic cell contains at least one bipolar electrode which is comprised of an anode plate and a cathode plate, joined together and in electrical contact with each other. The anode plate and the cathode plate are respectively fabricated from suitable anodic and cathodic materials.

In the past, the most frequently used material for the bipolar electrodes has been graphite. Graphite is considered a satisfactory material for the cathode side of a bipolar electrode, but generally is rather unsatisfactory for the anode side of the bipolar electrode. The anode side tends to be oxidized, and, to some extent, graphite disintegrates to sludge and wears away. As the electrode wears away, the gap or distance between the electrodes increases, and there is corresponding increase in the electrical resistance of the cell.

It has been proposed to overcome this problem by utilizing an anode plate fabricated of a valve metal, such as titanium, coated or faced with a platinum group metal and/or oxide on the anodic surface.

However, when such bipolar electrodes are utilized in processes in which hydrogen is evolved at the cathode surface, they are subject to a disadvantage. During the electrolysis of an alkali metal halide in a bipolar electrolytic cell, for example, nascent hydrogen is formed at the cathode surface on the cathode side of a bipolar electrode. When the cathode is fabricated of a layer of ferrous metal such as iron or steel, the nascent hydrogen permeates through the cathode material and into the metal bonded on the anode side of the electrode. If this is titanium metal it can cause blistering, embrittlement, flaking, misalignment, and stress cracking of the titanium portion of the electrode. Titanium hydride may also be formed; however, hydrogen can permeate through titanium hydride, therefore, the initial formation of titanium hydride does not provide a barrier. As the hydrogen permeates through the titanium hydride, more titanium hydride is formed, and there is further deterioration of the titanium anode. This deterioration can eventually cause the titanium anode to separate from the anodic coating or from the cathode.

The deterioration of titanium anode portion significantly decreases the useful life of bipolar electrodes, contaminates the products produced by the bipolar electrolytic cells, and increases the costs of operation. Although it is possible to use cathode materials other than steel or graphite, which are less permeable to hydrogen, for example, chromium, copper or nickel, such materials are also permeable to hydrogen to some extent, so that steel or graphite are still the most economical and practical materials to use as the cathodes.

DESCRIPTION OF PRIOR ART

Various laminated or layered electrodes have previously been proposed. U.S. Pat. No. 3,884,792 proposes a layered electrode of coated titanium separated from the cathode portion by a barrier layer of a metal, such as gold, tin, lead, nickel, cobalt, or copper. U.S. Pat. No. 3,878,084 proposes a germanium layer to separate the anode and cathode portions of an electrode. U.S. Pat. No. 3,649,355 proposes a tungsten-carbon electrode. Japanese application SHO No. 45-25083 proposes an electrode having a steel face separated from a graphite face by a barrier layer of conductive metal particles in a resin matrix.

BRIEF DESCRIPTION OF THE INVENTION

The present invention provides a composite bipolar electrode structure which includes an anode face comprised of a layer of a platinum group metal, metal oxide, or mixtures thereof, deposited on a layer of a valve metal, preferably titanium; a cathode face comprised of a cathode material, such as a ferrous material; and, an intermediate layer of conductive, porous material, for example, graphite, positioned between and in electrical contact with the valve metal and the cathode material. The components of the electrode, the valve metal, conductive, porous material, and cathode layers, are joined, and in electrical contact along substantially their entire interfacing surfaces. The composite electrode is fabricated by applying a thin layer of polymeric material to the interface areas and pressing the components with sufficient pressure to force the polymeric material into the interstices of the graphite component. Heating may be carried out concurrently, if desired or if required, dependent upon the polymeric material utilized. In one mode of the present invention, the polymeric material contains a conductive dispersion of metal particles to provide additional electrical conductivity. In another mode of the invention, where the electrodes are to be utilized without protecting frames, the edges of the composite electrode are sealed with a layer of polymeric material, preferably a fluorocarbon polymer, resistant and stable under the internal operating conditions of an electrolytic cell. The intermediate graphite layer may be vented to allow the escape of hydrogen gas.

The term "valve metal," as used herein, means a metal which is not generally used as an anode, due to the formation, under anodic conditions, of the oxide of the metal, which oxide, once formed, is highly resistant to the passage therethrough of electrons. Examples of valve metals, other than titanium, are tantalum, niobium, zirconium, and hafnium.

DETAILED DESCRIPTION OF THE INVENTION

Figure 2:
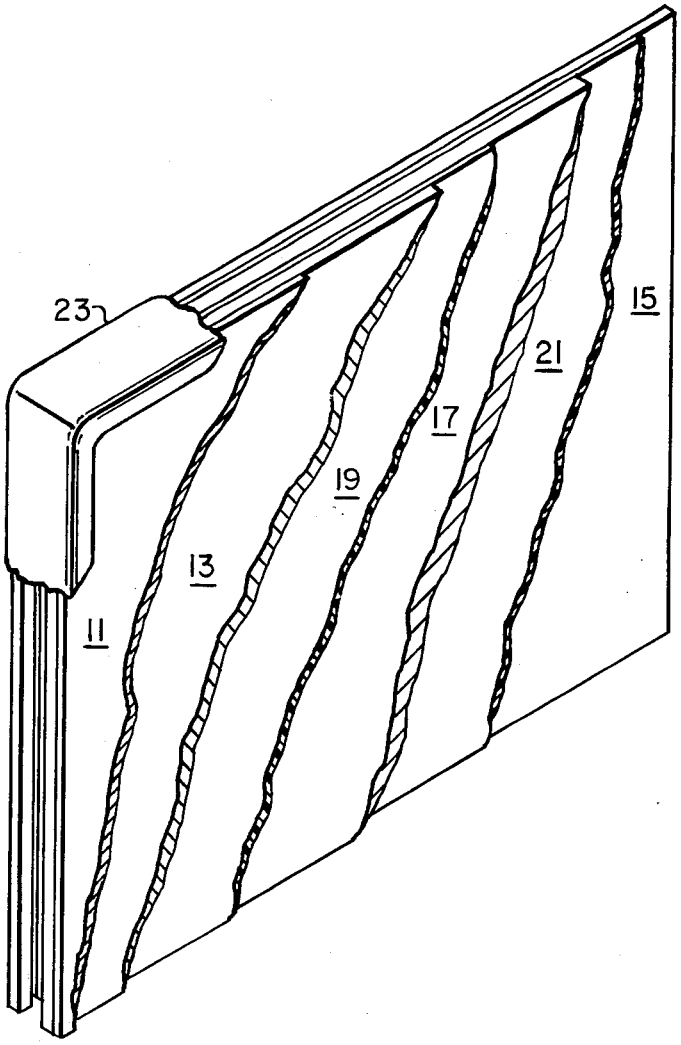
Figure 1:
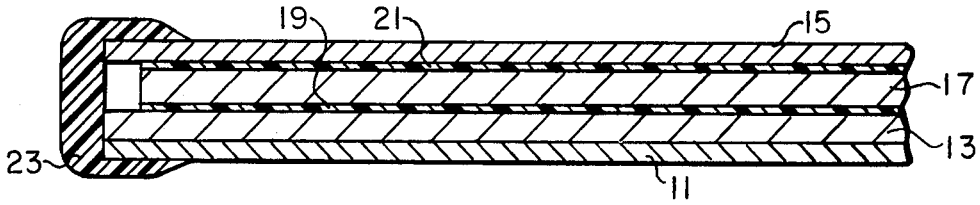

The accompanying FIGS. 1 and 2 are used to better illustrate the present invention. FIG. 1 is a perspective cross-sectional view of a composite electrode. FIG. 2 is frontal perspective partially cutaway showing the layered structure of FIG. 1. In the figure anode face 11 comprised of a coating of a platinum group metal, metal oxide, or mixtures thereof, is deposited on one face of valve metal layer 13. Suitable platinum group metals include platinum, ruthenium, rhodium, palladium, osmium and iridium. Various methods can be used to apply the coating to the valve metal face. Typical prior art methods are precipitation of the metals or metal oxides by chemical, thermal, or electrolytic processes, by ion plating, or by vapor deposition. The inner face of valve metal layer 13 is separated from the inner face of cathode material layer 15 by an intermediate graphite layer 17. The cathode material layer 15 is suitably fabricated of a ferrous material, such as iron, steel, or other metals such as chromium, cobalt, copper, molybdenum, nickel, tin, tungsten, or alloys thereof. The edges of the electrode may suitably be sealed with a layer or cap 23 comprised of a polymeric material stable under the operating conditions of an electrolytic cell. Suitable materials are resistant to corrosion by the cell electrolyte and the operating temperatures of a bipolar cell. Exemplary of such suitable materials are various thermoplastic or thermosetting resins, such as polybutylene, polymonochlorotrifluoroethylene, polytetrafluoroethylene, chlorinated polyethers, fluorinated ethylene propylene polymer, copolymers of ethylene and tetrafluoroethylene, copolymers of ethylene and monochlorotrifluoroethylene, polyvinylidene difluoride, polyethylene or chlorinated polyvinylchloride. A perfluoroalkoxy resin marketed by E. I. DuPont under the designation PFA is particularly useful.

The internal face of valve metal layer 13 is joined to graphite layer 17 by a thin layer of polymeric material 19, which, after the components are pressed to form the electrode is dispersed substantially entirely within the pores of graphite layer 17, providing electrical contact between valve metal layer 13 and graphite layer 17 along substantially the entire interface area. Similarly, the opposite face of graphite layer 17 is joined with cathode material layer 15 by polymeric material 21. The polymeric material is selected from those that are stable under thermal conditions of cell operation, usually between about 40° and about 95° C., and which strongly adhere to the graphite metal surfaces. Various thermosetting or thermoplastic resins may be used. Suitable resins include thermosetting resins such as phenolic and ureaformaldehyde resins, epoxy resins; thermoplastic resins such as polystyrene, polyethylene, polymethacrylate, vinyl polymers and copolymers, cellulose acetate, acrylics, and fluoropolymers such as those previously described as useful for forming an edge seal or cap. The polymeric material may be selected from resin blends, for example, blends of phenolic-vinyl resins, phenolic polyvinyl butyral resins, phenolic-polyvinyl formaldehyde resins, phenolic-nylon resins, and nitrile-phenolic resins. The polymeric material may be suitably selected from elastomeric materials, for example, artificial or natural rubbers, such as Neoprene, Buna-N, or silicones.

The polymeric material may contain a dispersion of conductive particles, suitably of metal, to increase, or insure, electrical conductivity of the composite electrode. The conductive particles may be selected from noble metals such as platinum, gold or silver; however, the economic consideration of using such metals leads to the more practical use of conductive materials such as copper, aluminum, iron, nickel and graphite. Preferably, the particles are cleaned before incorporation into the resin matrix. Generally, improved electrical conductivity is obtained when the amount of conductive material is at least about 50 percent by volume of the mixture.

The electrodes of the present invention may be suitably fabricated by applying an anodic layer, preferably a platinum group metal, metal oxide, or mixtures thereof, on one face of the valve metal layer to the extent of about 0.0001 inch thick. Although a lesser or greater thickness may be utilized, it is only necessary that the anodic material be present on the anodic side of the valve metal in an amount sufficient to allow that side to function effectively as an anode. Examples of anodic layer materials are platinum group metals, such as ruthenium, rhodium, palladium, osmium, iridium, or platinum, and oxides of a platinum group metal, such as ruthenium oxide. The platinum group metals or metal oxides may also be utilized together with an oxide of a film-forming metal, such as titanium dioxide.

The graphite layer is suitably fabricated of an electrolytic grade graphite, preferably having a porosity of about 30 to about 50 percent by volume. The thickness of the graphite layer may be varied from about 1/16 inch to about 2 inches, dependent upon the desired thickness of the finished electrode. Within this range, thicknesses between about ⅛ inch and about 1 inch are particularly useful. Usually, thicknesses less than about 1/6 inch are handled with difficulty, and thicknesses over about 2 inches are generally not advantageous because of the electrical resistance of the thick graphite layer.

The cathode material layer may also be varied in thickness, within a rather wide range, dependent upon the thickness of the electrode that is desired. The cathode material layer may range from about 2.0 mils to about ½ inch in thickness. Within this range, thicknesses between about 1/32 inch and about ⅛ inch have been found particularly useful. Generally, thicknesses less than about 2.0 mils are used with caution because of the potential of holes in the layer, and usually thicknesses over about ½ inch provide no additional advantages.

The surface areas of the components which are to be joined are preferably processed by machining, grinding, or polishing to have substantially coplanar interfacing surfaces. Prior to assembly, the surfaces to be joined are preferably cleaned, suitably by vapor degreasing or sand or grit-blasting and in some cases anodized to insure good adhesion. The components may be assembled into an electrode by a number of ways; for example, by initially positioning a layer of polymeric materials, in the form of a film, or by spreading, painting, or spraying between the interfacing areas and pressing the components together with sufficient pressure to force the polymeric material into the pores of the graphite layer. Pressures up to the cracking point of the graphite layer may be utilized. Generally, pressures of at least about 10 psi are required, and pressures from about 150 to about 500 psi are useful. The pressure is preferably maintained until the polymeric material is cured or set. Heat may be applied to cause the polymeric material to flow, or, in the case of a thermosetting resin, to cause the resin to set.

In assembling the electrodes of the present invention which are to be provided with an edge seal or cap, it has been found that a particularly durable and lasting seal may be provided if the valve metal layer and the cathode material layer are separately, initially pretreated. The pretreatment consists of cleaning the edges and a periphery area on the surfaces, applying a coating of a suitable fluorocarbon resin, for example, perfluoroalkoxy resin, and heating in a vacuum at a temperature between about 350° and about 420° C. The layers are then cooled and assembled into an electrode as described above. After assembly, the cap is provided by coating the edges of the electrode and extending the coating to cover the pretreated periphery areas of the face of the anode and the cathode layers. The cap coating may suitably be applied by utilizing a fluorocarbon resin in the form of a ribbon or film, or by spraying, painting or spreading.

The present electrodes are preferably equipped with a vent. The vent may be provided by simply not sealing or capping a portion of the edge of the electrode or may be provided by forming an opening in the edge portion of the electrode and providing an escape line or pipe for the hydrogen to be vented outside of the confines of the cell.

The following examples are exemplary only:

EXAMPLE 1

A plate of low carbon steel 4½ inches by 5 inches was cleaned of oils and greases by washing with trichloroethylene, followed by soaking in isopropyl alcohol for one hour in an ultrasonic cleaning apparatus. The plate was then rinsed with isopropyl alcohol followed by methyl alcohol. After drying for fifteen minutes, the plate surfaces were grit-blasted with 120 mesh aluminum oxide grains for three minutes on each side. Any loose dust remaining on the surface was removed by a filtered and dried jet of compressed air.

Two pieces of a fluorocarbon film, DuPont Teflon Type PFA, 0.018 inches in thickness were cut to 5 inches by 6 inches, and a central opening of about 3½ inches by 4 inches was cut out, the longer side of the opening being parallel to the longer side of the strip. The films were then cleaned by scrubbing with methanol followed by a 15-minute soak in isopropyl alcohol in an ultrasonic cleaning apparatus with a subsequent rinse in methyl alcohol and dried in dust-free air.

Using steel tongs, one piece of the fluorocarbon film was centered on a sheet of thin aluminum foil about 6 inches by 8 inches. The steel plate was then placed atop the film, centered over the 3½ inch by 4 inch opening. The second piece of fluorocarbon film was then placed atop the steel plate directly above the first film. The space at the edges of the plate between the two pieces of film was then filled with an assemblage of narrow strips of the fluorocarbon film, cleaned as described above. A second piece of thin aluminum foil 6 inches by 8 inches was then placed atop the upper fluorocarbon film and the edges of the aluminum foil folded to within about ¼ inch of the fluorocarbon film to encase the entire assembly.

A rectangular sheet of steel about 3½ inches by 4 inches 0.015 inches thick was placed on top of the aluminum foil envelope centered over the 3½ inch by 4 inch opening in the fluorocarbon film. The entire assembly was then turned over and a second steel sheet similar to the first was positioned over the 3½ inch by 4 inch opening in the other piece of fluorocarbon film.

The entire assembly was then placed in a stainless steel envelope structure having flexible top and bottom surfaces 0.008 inches in thickness. The steel envelope was sealed and a vacuum applied, causing the flexible sides to collapse against the enclosed assembly. Dry, oxygen-free argon was then admitted into the steel assembly to bring the internal pressure to approximately 0.01 to 0.001 mm. Hg. The steel envelope was reevacuated and similarly repressured three times ending in an evacuation. The steel envelope was then heated to 200° C. for a period of thirty minutes, after which the temperature was rapidly raised to 400° C. over a period of thirty minutes. A 400° C. temperature was then maintained for a period of 15 minutes, at which time the vacuum in the steel envelope was relieved by the admission of oxygen-free argon to about 0.9 atmospheres. After an additional period of 15 minutes at 400° C., the temperature was reduced rapidly to 350° C. and the entire assembly immersed in an ice bath.

The assembly was dismantled and the original steel plate removed. The steel plate was found to have a strongly adherent coating of fluorocarbon polymer covering the edges and extending onto the two faces of the plate.

A titanium plate 4½ inches by 5 inches having a thickness of 0.060 inches was coated on one face with a 70 percent platinum—30 percent iridium alloy, except for a 9/16 inch strip along the four edges. The titanium plate was then degreased and dried in the manner described above in the preparation of the steel plate. The coated area was then protected with a ⅛ inch thick rubber mat clamped to the surface of the titanium plate. The exposed areas were then grit-blasted in the manner previously described.

The titanium plate was then processed as described above to provide the titanium plate with a coating of fluorocarbon polymer covering the edges and extending onto the two faces of the plate.

A graphite plate 3½ inches by 4 inches having a thickness of 5/16 inches and a porosity of about 50 percent was milled along the four edges to provide a step ¼ inch wide and 0.020 inches deep. The graphite plate was then rinsed with isopropyl alcohol and then immersed in a bath of isopropyl alcohol in an ultrasonic cleaning apparatus. The plate was then removed, washed with methyl alcohol and dried. A strip of 0.018 inch DuPont Teflon PFA film 11/16 inches wide by 16 inches long was then wrapped around the edges of the graphite plate. The overlap area was tacked together with a heated quartz rod. The edges of the film were notched at the corners of the plate, and the edges of the film extending beyond the graphite surface were folded down into the milled steps in the edge of the graphite plate.

An epoxy resin was formulated using Union Carbide Bakelite Epoxy by mixing 100 grams of No. ERL 2256 resin with No. ZZL 0820 hardner. The two faces of the graphite plate were painted with the epoxy resin mixture. The remaining epoxy resin mixture was allowed to age for a period of 24 hours.

The uncoated surfaces of the steel plate and the titanium plate were again cleaned by grit-blasting, and the cleaned areas painted with the 24-hour aged epoxy resin mixture.

The electrode was then assembled by placing the epoxy resin coated portion of the graphite plate in aligned contact with the epoxy resin coated portions of the steel plate and the titanium plate. An aluminum plate 3½ inches by 4 inches, having a thickness of ⅛ inch was then centered over the area bounded by the fluorocarbon resin on the outer surface of the titanium plate and a second similar aluminum plate centered over the area bounded by the fluorocarbon resin on the outer surface of the steel plate. This assembly was then placed in a hydraulic press and a pressure of 750 psi applied. The temperature was raised from ambient to 150° C. over a period of about 30 minutes. The temperature and pressure was maintained constant for one hour and then cooled rapidly to room temperature.

The electrode was then removed and the junctions between the PFA strip around the edges of the graphite and the coatings on the edges of the steel and titanium plate were welded together with a plastic welding tool using PFA strip as filler. The electrode was provided with a vent by drilling a ⅛ inch diameter hole through the fluorocarbon coating in the area of the overlap of the film around the graphite edge and into the graphite plate to a depth of about 1 inch. A ⅛ inch diameter stainless steel tube 3 inches long was inserted into the hole to the bottom. A 5/32 inch diameter tube of DuPont Teflon PFA 12 inches long was then slipped over the steel tube, and the junction with the fluorocarbon seal welded with a heated quartz rod and PFA filler strips.

EXAMPLE 2

The procedure of Example 1 was followed, except that a film of DuPont Teflon PFA was utilized in place of epoxy resin and a different temperature and pressure was utilized to form the composite. In this example, the graphite plate faces were coated with a film of DuPont Teflon PFA 5 mils in thickness. The plates otherwise were prepared and assembled as described in Example 1. The hydraulic press pressure was maintained at 500 psi, and a temperature of 375° to 400° C. was maintained during pressing.

EXAMPLE 3

The procedure of Example 1 was followed, except that a film of nitrile-phenolic resin, a product of B. F. Goodrich designated as PL-601, was utilized in place of the epoxy resin and a different temperature and pressure was utilized to form the composite. In this example, the graphite plate faces were coated with a film of B. F. Goodrich PL-601 10 mils in thickness. The plates otherwise were prepared and assembled as described in Example 1. The hydraulic press pressures were maintained at 300 psi, and a temperature of 190° C. was maintained for 20–25 minutes during pressing.

The electrodes of the present invention are adapted to use in bipolar or filter-press type electrolytic cells. Such cells are particularly useful in processes involving the electrolysis of aqueous solutions of alkali metal halides. When the present electrodes are utilized in such processes, a halogen, typically chlorine, is produced at the anode face, and an alkali metal hydroxide, typically sodium hydroxide, is produced at the cathode face. The electrolysis products may be allowed to react within the cell to produce alkali metal halates, for example, sodium chlorate. Alternatively, the electrodes may be separated by a suitable membrane or diaphragm and the electrolysis products, e.g., halogen gas and alkali metal hydroxide, recovered as separate products.

Although the present invention has been described with respect to several embodiments, it is not to be construed as limited to these, as it will be evident to one of ordinary skill in the art that substitutions and equivalents are possible without departing from the spirit of the invention or the scope of the appended claims.

What is claimed is:

1. A composite electrode for use in a bipolar electrolytic cell comprising
   (a) an anode face, comprised of a layer of a platinum group metal, metal oxide, or mixtures thereof, deposited on
   (b) one face of a valve metal layer, the opposite face of said valve metal layer joined, and in electrical contact, along substantially its entire surface with
   (c) one face of graphite layer, the opposite face of said graphite layer joined, and in electrical contact, along substantially its entire surface with
   (d) one face of a cathode material layer, the opposite face of said cathode material layer, providing a cathode face, said valve metal layer, graphite layer, and cathode material layer being joined by a polymeric material on each face of said graphite layer.

2. The electrode of claim 1 which includes a polymer cap encasing the edges of said electrode and extending into said anode and said cathode face.

3. The electrode of claim 2 wherein the said cap is a fluorocarbon polymer.

4. The electrode of claim 3 wherein the fluorocarbon polymer is a perfluoroalkoxy resin.

5. The electrode of claim 1 wherein the said graphite layer has a vent to allow the escape of hydrogen gas during operational use of the electrode.

6. The electrode of claim 1 wherein the polymeric material contains a dispersion of conductive material.

7. The electrode of claim 6 wherein the conductive material is a metal.

8. The electrode of claim 1 wherein the valve metal is selected from the group of titanium, tantalum, zirconium, and hafnium.

9. The electrode of claim 1 wherein the valve metal is titanium.

10. The electrode of claim 1 wherein the cathode material is a ferrous material.

11. The electrode of claim 10 wherein the ferrous material is steel.

* * * * *